US011787024B2

(12) United States Patent
Haskins

(10) Patent No.: US 11,787,024 B2
(45) Date of Patent: Oct. 17, 2023

(54) SCREW/NUT/BOLT DRIVER FOR PNEUMATIC, IMPACT, HAND CRANK OR OTHER USE HAVING AN INSERTABLE MAGNET IN THE HEAD TO HOLD/KEEP SCREW/NUT/BOLT OR SPECIALIZED TIPS ATTACHED TO DRIVER BUT INSERTED BY SCREWING IT IN, AS IT IS THREADED AND INSIDE OF DRIVER HEAD (BELOW SCREW/NUT/BOLT RECEIVING AREA), IS IDENTICALLY THREADED TO RECEIVE IT

(71) Applicant: Thomas Ellis Stanley Haskins, Holbrook, MA (US)

(72) Inventor: Thomas Ellis Stanley Haskins, Holbrook, MA (US)

( * ) Notice: Subject to any disclaimer, the term of this patent is extended or adjusted under 35 U.S.C. 154(b) by 0 days.

(21) Appl. No.: 17/128,448

(22) Filed: Dec. 21, 2020

(65) Prior Publication Data

US 2022/0193869 A1 Jun. 23, 2022

(51) Int. Cl.
*B25B 23/12* (2006.01)
*B25B 23/00* (2006.01)

(52) U.S. Cl.
CPC ..... *B25B 23/12* (2013.01); *B25B 23/0035* (2013.01)

(58) Field of Classification Search
CPC ..... B25B 23/12; B25B 23/0035; B25B 15/00; B25B 15/02; F16B 39/284; F16B 39/30
USPC ..... 81/438; 411/277
See application file for complete search history.

(56) References Cited

U.S. PATENT DOCUMENTS 2,782,822 A * 2/1957 Clark ..... B25B 23/12 81/125
2,838,082 A * 6/1958 Lange ..... B25B 23/12 81/438
3,126,774 A * 3/1964 Carr et al. ..... B25B 13/481 81/125
3,392,767 A * 7/1968 Stillwagon, Jr. ..... B25B 23/12 81/125
3,517,717 A * 6/1970 Orlomoski ..... B21H 3/06 411/311
3,630,108 A * 12/1971 Stillwagon, Jr. ..... B25B 23/12 81/125
3,707,894 A * 1/1973 Stillwagon, Jr. ..... B25B 23/12 81/125
5,012,708 A * 5/1991 Martindell ..... B25B 23/0064 81/429

(Continued)

*Primary Examiner* — Don M Anderson
*Assistant Examiner* — Jason Khalil Hawkins

(57) ABSTRACT

The unique aspect of this invention is the fact that the magnet insert screws into the driver shaft head rather than being pressed in under pressure. The best design for this invention includes self-locking threads as well and the combination of using a threaded installation of the magnet insert and the locking threads is an additional unique attribute to this invention. This unique a threaded install attribute helps prevent the magnet insert from coming out under impact pressure and even if it does it allows it to be reinserted using a screwing mechanism and when reinserted will remain in place unlike existing press-in products. A third unique attribute of this invention is the depression at the top of the magnet insert designed to receive a screwing tools such as a flat head or Philips screw driver, hex, Allen, etc., making it possible to easily reinsert the magnet insert and tighten it firmly in place.

3 Claims, 2 Drawing Sheets

(56) References Cited

U.S. PATENT DOCUMENTS

| | | | | | |
|---|---|---|---|---|---|
| 5,277,088 | A * | 1/1994 | Vasichek | B25B 23/12 | 81/125 |
| 5,724,873 | A * | 3/1998 | Hillinger | B25B 23/12 | 81/125 |
| 5,868,048 | A * | 2/1999 | Cassutti | B25G 1/105 | 81/439 |
| 6,050,158 | A * | 4/2000 | Cassutti | B25G 1/085 | 81/439 |
| 7,204,177 | B1 * | 4/2007 | Garner | B25B 23/12 | 81/451 |

* cited by examiner

SCREW/NUT/BOLT DRIVER FOR PNEUMATIC, IMPACT, HAND CRANK OR OTHER USE HAVING AN INSERTABLE MAGNET IN THE HEAD TO HOLD/KEEP SCREW/NUT/BOLT OR SPECIALIZED TIPS ATTACHED TO DRIVER BUT INSERTED BY SCREWING IT IN, AS IT IS THREADED AND INSIDE OF DRIVER HEAD (BELOW SCREW/NUT/BOLT RECEIVING AREA), IS IDENTICALLY THREADED TO RECEIVE IT

BACKGROUND OF THE INVENTION

1. Field of the Invention

The present invention generally relates to a driver used to drive screws, nuts 10 and bolts, by direct application or using specialized tips, into surfaces using pneumatic, impact, hand crank or other mechanisms and will be used in commercial, industrial, consumer, medical and other construction/building, manufacturing and activities:

1. A hardened steel or other material rod (of varying lengths and widths)
2. An upper opening in the head (top) shaped to receive the screw/nut/bolt/tip
3. A lower, smaller opening in the head under the upper opening that is threaded and designed to receive magnet insert
4. Threads, regular and/or specially designed to self-lock and manufactured into the lower opening sidewalls
5. Magnet insert that is installed to keep screw/nut/bolt/tip attached to driver as during installation process/driver use
6. Threads, regular and/or specially designed to self-lock and manufactured into the magnet insert sidewalls
7. A special indentation in the top of the magnet insert shaped to receive a tool for screwing magnet into driver head. This indentation could be a slot for a slotted screw driver, a Philips-shaped indentation for a Philips screw driver, alien wrench, start, etc.
8. A further and significant benefit of this invention is that because the magnet insert is screwed in it can be removed and replaced at will. Frequently existing similar products gather metal debris inside the top opening preventing the screw/nut/bolt/tip head from fully entering the opening and this failing to fully engage with the driver, often stripping the screw/nut/bolt/bit or the driver head.

2. Description of Related Art

Current products and technology on the market include:

a. Current products on the market vary widely. Some have insertable magnets and some do not. None have an insertable magnet that is screwed into them. They are of various lengths and thicknesses as well. Some are designed to receive nuts, bolts, screws and some are designed to receive varyingly specialized tips for said purposes. The products that do have insertable magnets for the head/tip are not designed for the insertable magnet to be screwed in, easily removed and easily replaced. Because of this they have two basic flaws that render them less useful and less valuable and cause the user to be significantly less efficient and effective:
   I. The insertable magnet often falls out, and while the magnet can often be placed back in it will fall out again at the next use zo and even if it is glued back in that glue cannot handle the impact and rigors of use and function
   II. When the opening of the head/tip gets filled with ferris-based debris it is extremely difficult to clean it out because the magnet holds it in the bottom of the opening.

SUMMARY OF THE INVENTION

A screw/nut/bolt driver for pneumatic, impact, hand crank or other use having an insertable magnet in the head to hold/keep screw/nut/bolt or specialized tips attached to driver but inserted by screwing it in, as it is threaded and inside of driver head (below screw/nut/bolt receiving area), is identically threaded to receive it. What is primarily unique about this invention is the fact that the inserted magnet is screwed in such that it can be unscrewed to clean out ferris-based debri and if the magnet comes out of its own accord, can be reinserted easily in such a way that it will remain.

DETAILED DESCRIPTION OF THE INVENTION

The following detailed description is directed to certain specific embodiments of the invention. However, the invention can be embodied in a multitude of different ways as defined and covered by the claims and their equivalents. In this description, reference is made to the drawings wherein like parts are designated with like numerals throughout. Unless otherwise noted in this specification or in the claims, all of the terms used in the specification and the claims will have the meanings normally ascribed to these terms by workers in the art.

This invention is a screw/nut/bolt driver for pneumatic, impact, hand crank or other use having an insertable magnet in the head to hold/keep screw/nut/bolt or specialized tips attached to driver magnetically but inserted by screwing it in. It is threaded and the inside of driver head/tip (below screw/nut/bolt receiving area of head/tip), is identically threaded to receive it. This is the primary unique property of this invention. What is primarily unique about this invention is the fact that the inserted magnet is screwed in such that it can be unscrewed to clean out ferris-based debris that frequently will stick in and fill the opening of the head/tip and also if the magnet comes out of its own accord (which happens frequently), can be reinserted easily in such a way that it will remain (i.s. by just screwing it back in). Current products are pressed in under pressure or glued in and such process does not last under the duties of regular use.

a) driver
b) magnet insert
c) Upper opening in head of driver designed to receive screw/nut/bolt and/or specialized tips (illustrated using dashed lines)
d) Lower opening in head of driver under upper opening that is designed to receive threaded magnet insert (illustrated using dashed lines)
e) threads in lower opening inner side walls (illustrated using dashed lines)
f) threads in sides walls of magnet insert g) Bottom shaft tip designed to fit into pneumatic, impact, hand crank or other tool h) special indentation in the top of the magnet insert shaped to receive a tool for screwing magnet into driver top.

i) Driver head/top

Figure 1:
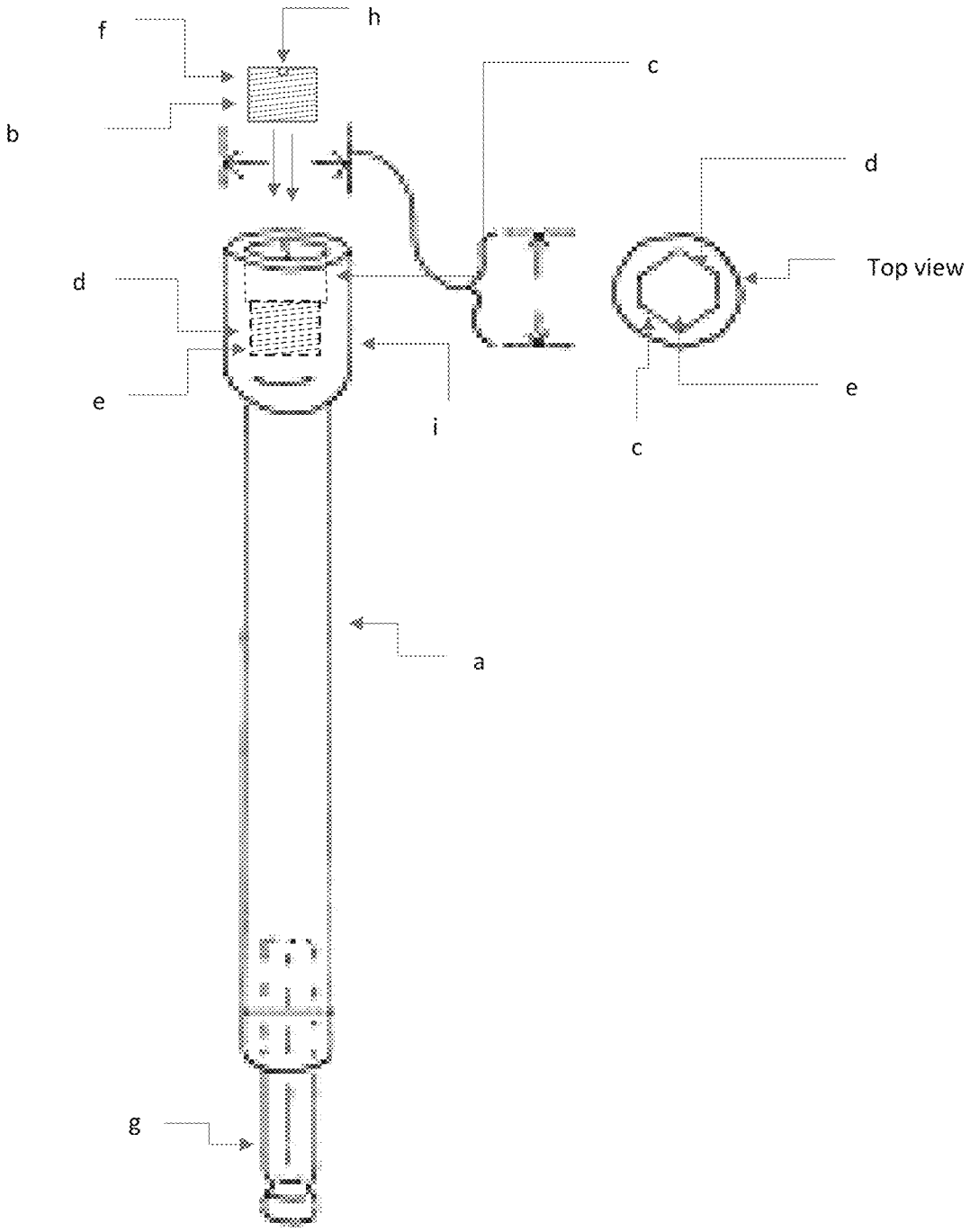
FIG. 1 illustrates a schematic side view and top view diagram of the driver showing the following.
Figure 2:
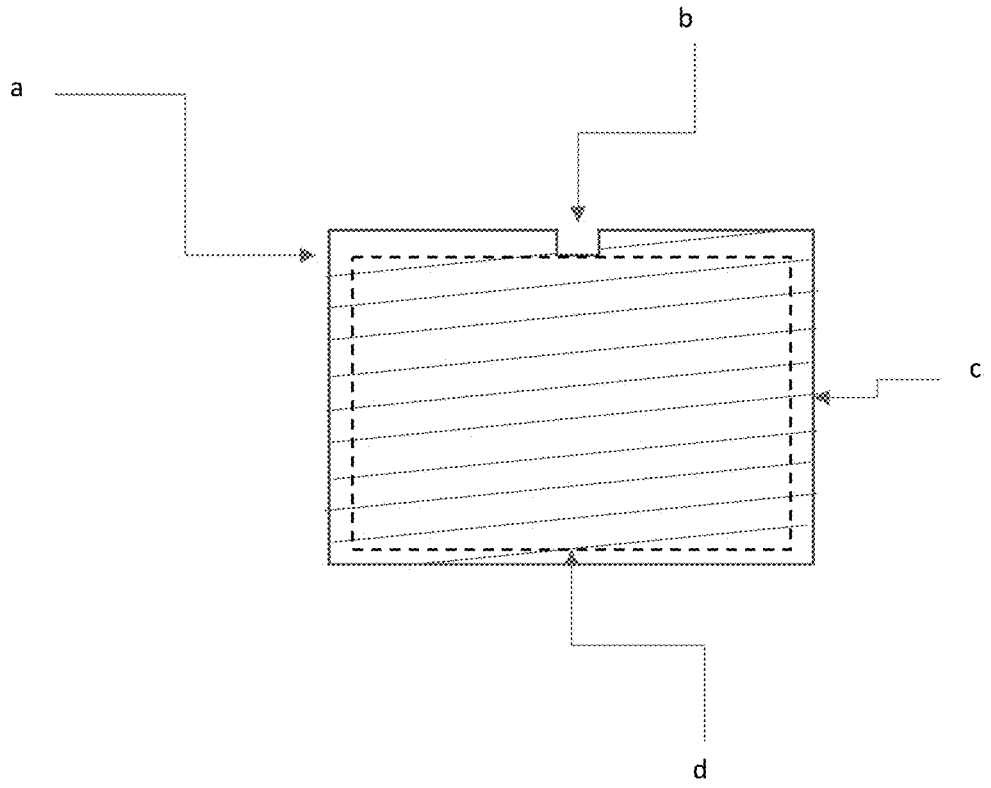

FIG. 2 Illustrates the closeup design of the magnet insert:

a) magnet insert unit b) special indentation in the top of the magnet insert shaped to receive a tool for screwing magnet into driver top.

c) Threads in side wall of magnet insert d) Magnet insert

These and other changes can be made to the invention in light of the above detailed description. In general, the terms used in the following claims, should not be construed to limit the invention to the specific embodiments disclosed in the specification, unless the above detailed description explicitly defines such terms. Accordingly, the actual scope of the invention encompasses the disclosed embodiments and all equivalent ways of practicing or implementing the invention under the claims.

The invention claimed is:

1. A tool driver comprising:

a shaft, and a bottom designed to fit into a pneumatic, impact, or hand crank tool; and a head designed to receive a screw, nut, bolt or specialized tip; and a center along a diameter of the tool head; and an axis extends from the bottom to the head of the tool driver through said center; and an upper opening centered on said axis in said head shaped to receive said screw, nut, bolt or specialized tip; and a lower opening centered on the axis, between the bottom and the upper opening; and a magnet insert casing received into said lower opening, designed to receive a magnet insert, said magnet insert casing with threads on an outer circumferential wall designed to match threads on an inner circumferential wall of said lower opening.

2. The tool driver of claim 1, wherein said magnet insert comprises an inner magnetic core; and when magnet insert is within said insert casing, all sides of said magnet insert are covered except for a top surface of the magnet insert.

3. The tool driver of claim 1, wherein said magnet insert casing comprises a depression in a top of said magnet insert casing designed to receive a turning tool to and remove or turn and install said magnet insert.

* * * * *